United States Patent [19]

de Boevé et al.

[11] Patent Number: 4,549,322

[45] Date of Patent: Oct. 29, 1985

[54] CRADLE ASSEMBLY ADAPTED TO BE RE-ASSEMBLED INTO A BED STEAD FOR ADULTS

[76] Inventors: André de Boevé; Ronny de Boevé, both of Borgesiusstraat 97, 3038 TG Rotterdam, Netherlands

[21] Appl. No.: 449,868

[22] Filed: Dec. 15, 1982

[30] Foreign Application Priority Data

Dec. 22, 1981 [NL] Netherlands ..... 8105779

[51] Int. Cl.[4] ..... A47D 7/00

[52] U.S. Cl. ..... 5/93 B; 5/2 R; 5/99 B; 5/101

[58] Field of Search ..... 5/2 R, 93 B, 99 R, 99 B, 5/101, 102, 127, 175, 129, 174, 181, 201, 202, 285; 297/119, 129; 108/18

[56] References Cited

U.S. PATENT DOCUMENTS

| | | | |
|---|---|---|---|
| 871,692 | 11/1907 | Gray | 5/101 |
| 916,517 | 3/1909 | Wilsch | 5/129 |
| 1,227,710 | 5/1917 | Walsh | 5/101 |
| 1,715,600 | 6/1929 | Hoover | 5/101 |
| 3,668,722 | 6/1972 | Gallant | 5/127 |
| 4,205,876 | 6/1980 | Cetina | 5/101 |

*Primary Examiner*—Gary L. Smith
*Assistant Examiner*—Michael F. Trettel
*Attorney, Agent, or Firm*—Murray Schaffer

[57] ABSTRACT

This cradle assembly (1) comprises a cradle tray, a pedestal (2) two uprights of full length (3), two uprights of half length (4) and a couple of connecting rods (5).

The assembly may be easily re-assembled into a cot and into a bed stead for adults in order to adapt it to the increasing age of the baby, which is initially placed in the cradle, when the assembly is in the cradle arrangement.

1 Claim, 4 Drawing Figures

CRADLE ASSEMBLY ADAPTED TO BE RE-ASSEMBLED INTO A BED STEAD FOR ADULTS

The invention relates to a cradle assembly. The disadvantages of existing cradles for children is that all too soon they are too small for the growing child so that a crib has to be bought. Soon thereafter, also this crib is no longer sufficient and it is interchanged for an adult a bedstead.

The purpose of the present invention is the provision of a cradle, assembled from a plurality of parts which may be reassembled by demounting and remounting into a different assembly, i.e. a crib as well as into a bedstead for adults.

This is achieved according to the invention in that the assembly comprises a cradle tray, a pedestal of equal length to the cradle tray, two uprights adapted to be laterally connected to the pedestal and to the cradle tray such that the cradle tray is situated substantially at half the height of the uprights, two uprights having half the length of the first mentioned uprights, provided against the first mentioned uprights between the pedestal and the cradle tray, and one or more rods interconnecting the uprights.

This construction permits assembling a piece of bedding furniture of each of the above mentioned types of attractive appearance, using simple parts which, moreover, are easily mountable and demountable.

For additional protection of the young child two plates, e.g. manufactured from a transparent plastic, may be provided and adapted to be connected to the uprights, the uprights of half length and the cradle tray or to any of said parts when the assembly is made to provide a cot.

In order to provide rigidity of the structure while retaining the possibility of simple assembly, it is preferable to provide the rods with a circular cross-section, to manufacture them from wood and to provide a centered end hole, having interior screw thread, end caps being provided of light material and with equal diameter as the rods, said caps having a projecting screw through which they may be screwed into the end holes of the rods, extending through the uprights.

In order to obtain a stable position of the assembly when assembled as a cradle, preferably the pedestal is a flat block of which one of the flat sides has been omitted.

The invention will hereunder be further illustrated with reference to the drawing in which an embodiment of the cradle assembly according to the invention, given as an example, is shown.

Figure 1:
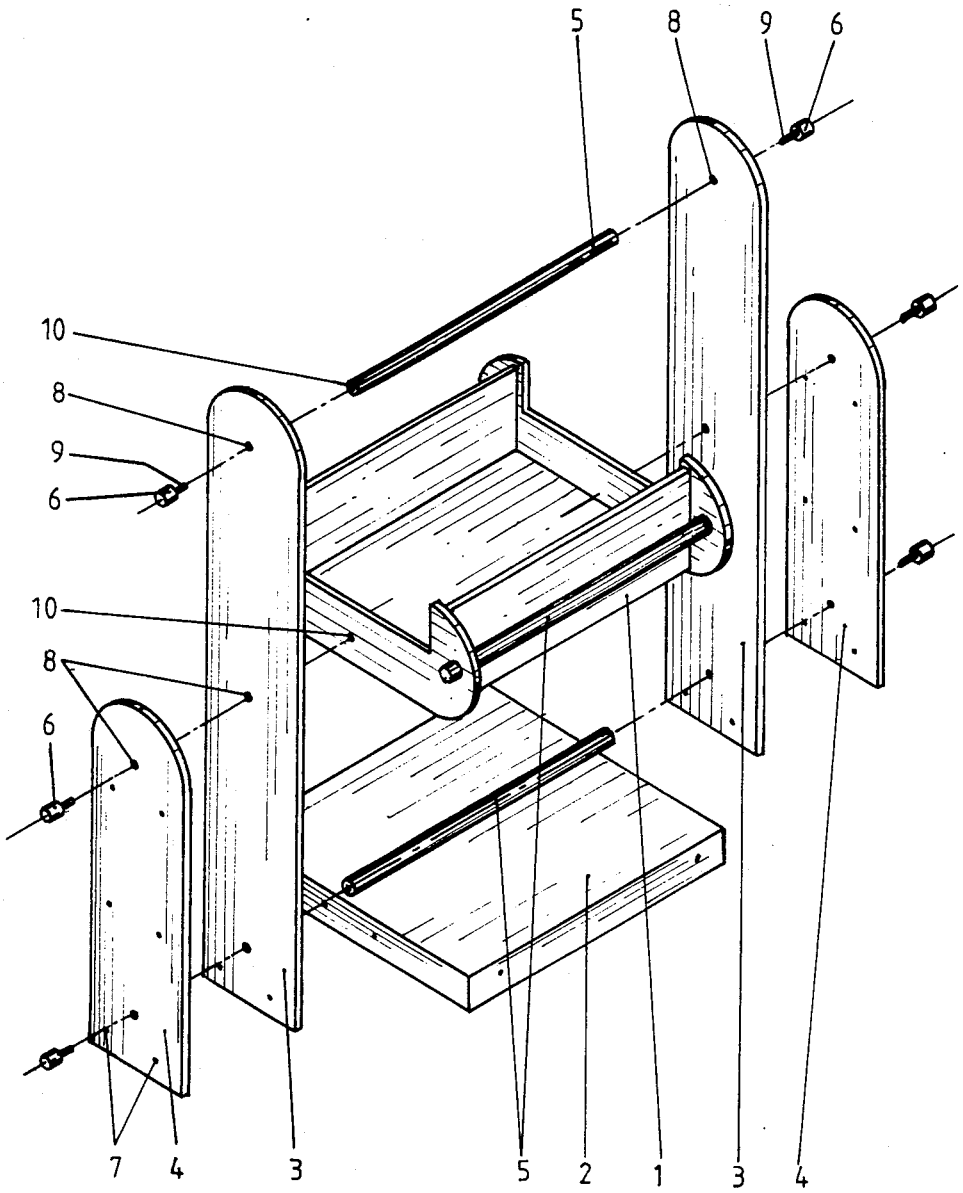
FIG. 1 shows a perspective view of the separated parts of the assembly, shown in the positions for assembling into a cradle.

The assembly of parts shown in FIG. 1 comprises a cradle tray 1, a pedestal 2 having a width equal to the width of the cradle tray in the direction extending from one upright to the other, two uprights 3, two uprights 4 of half the length thereof, two rods 5 havin end caps 6.

Figure 2:
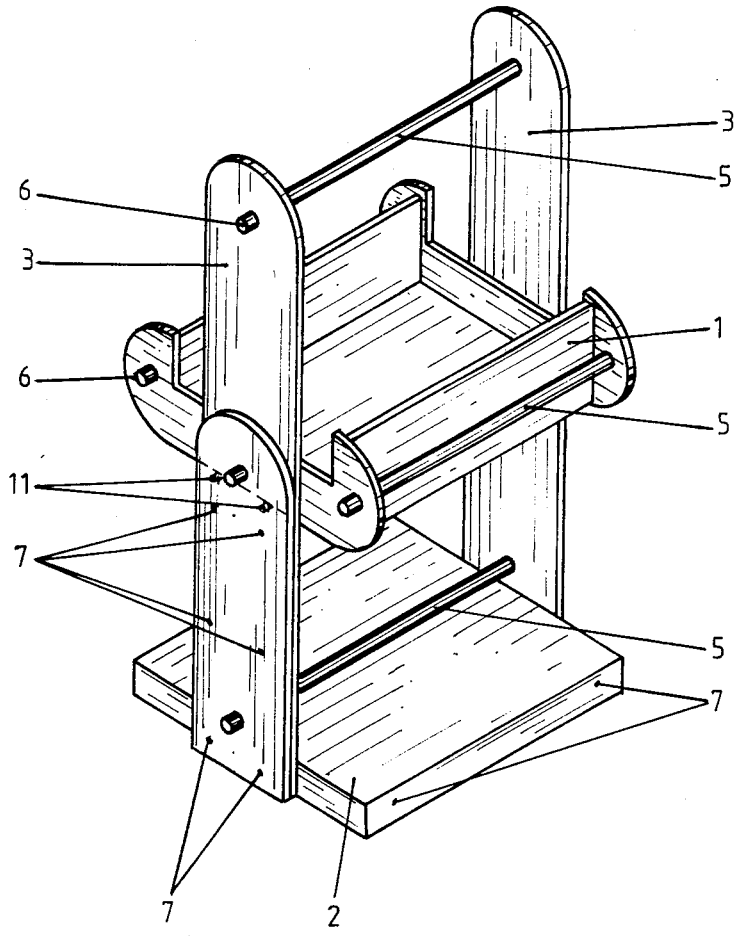
FIG. 2 is a perspective view of the assembly mounted into a cradle.

It appears from FIGS. 1 and 2 in what manner a cradle may be assembled from said parts. Thereto first the uprights 3 are laterally secured against the pedestal 2, e.g, each by means of two connecting bolts with nuts, which are not shown and whereby simultaneously on the outside an upright 4 of half the height is secured against each upright 3. The holes for said connecting bolts are indicated by reference number 7 in FIG. 2. Thereafter the oppositely situated uprights are interconnected by the rods 5 having end caps 6. For that purpose the uprights have holes 8, indicated in FIG. 8, adapted for threading a screw 9 through said holes, said screw extending from an end cap 6 through the holes 8 of uprights 3 and 4 at one side, positioned against each other and screwed beyond the upright 3 into a hole, e.g. through a sleeve having interior screw thread (10 in FIG. 1) provided at the ends of the rods 5. Thereby the uprights are drawn towards each other and secured at the lower end and at the upper end of the structure, whereby at the lower end the pedestal 2 is connected between said uprights.

The cradle tray 1 is secured in the same manner to the uprights, substantially at half the height between the rods 5 at the lower end and at the upper end, by means of identical end caps 6, which now extend through the uprights 3 and 4 and are screwed into a sleeve having interior screw thread 10, provided in the side of the cradle tray. In addition so called shelf carries (indicated by reference number 11 in FIG. 2) are inserted at the side of the uprights 3 facing the cradle tray, at the positions where the lower edges of the cradle ends are situated after having been secured through the caps 6. Such shelf carries are generally known for positioning shelves in cupboards and so-called open wall cupboards. The shelf carries 11 not really serve for carrying the weight of the cradle tray but for preventing the tray from pivoting around the single connection point constituted by the caps 6. In the embodiment shown at both sides of the cradle tray, the shape of which is clearly shown in the drawing, in identical manner rods 5 having end caps 6 are provided. The rods have a decorative effect, but may also serve for connecting thereto, together with the upper rod 5, a cradle enclosure or cradle curtains manufactured from textile fabric.

The pedestal 2 could be a solid structure but is preferably hollow, the lower wall, not visible in FIG. 2, may be omitted, which has an additional advantage which will be discussed hereunder.

Figure 3:
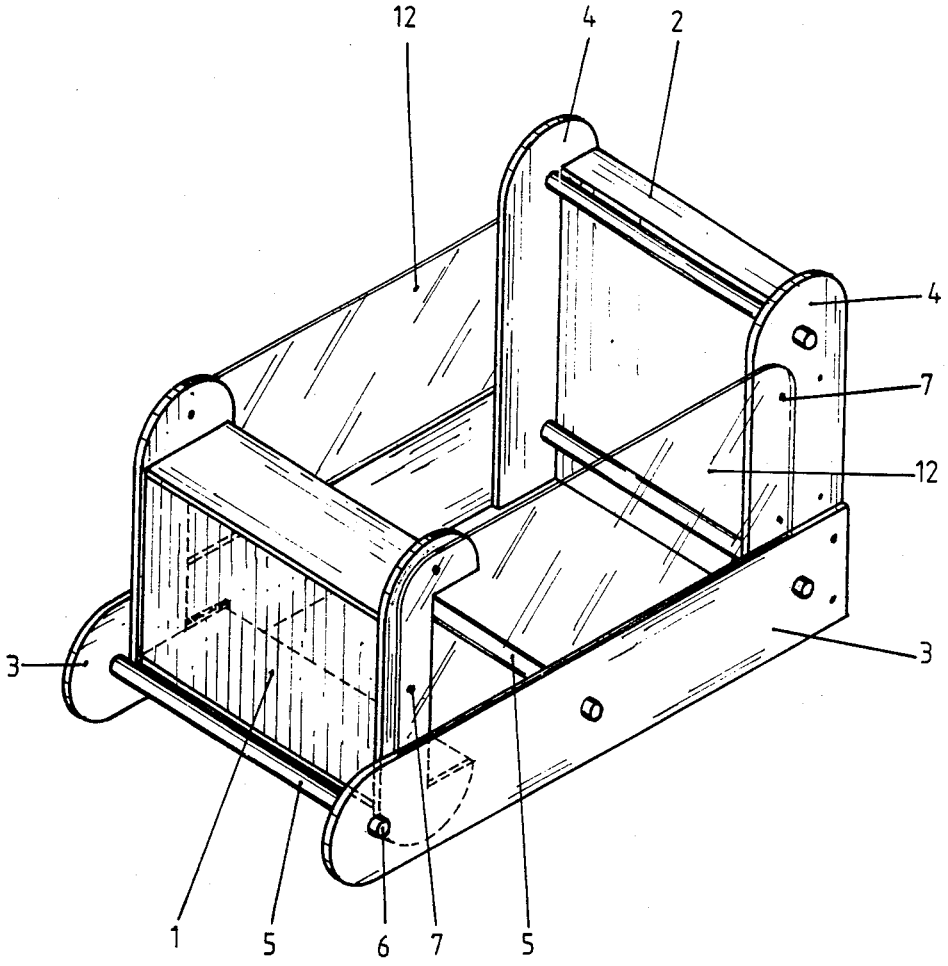
FIG. 3 is a perspective view of the assembly mounted into a cot.

FIG. 3 shows the assembly arranged as a crib. In this arrangement the long uprights 3 are placed horizontally on the floor and the half uprights 4 are placed vertically at the head end of the cot. The uprights 4 are mutually connected by the rods 5 and caps 6, at the ends of the uprights, in the same manner as according to FIG. 2, while an additional rod 5, not used in the cradle assembly, is provided intermediate the length of the uprights, in the same holes as through which the caps 6 for the connection of the cradle in FIG. 2 are provided. An additional rod 5 having caps 6 is also provided at the upper ends of the half uprights 4 in the same holes serving for connecting the cradle to said half uprights according to FIG. 2. The cradle tray 1 is placed at the foot end between the uprights 3. Preferably said cradle tray has a length which is larger than its width, i.e. that the spacing between the head end and the foot end in the direction parallel to the rods 5 is larger than the spacing between the sides adjacent to the rods 5. Said cradle 2 is placed between the uprights 3 such that the length of the cradle tray constitutes the width of the crib.

Sidewalls shaped as plates 12 may be provided against the sides of the cot formed in the above described manner, for further protection of the child lying in the crib. Preferably said plates are manufactured from a transparent plastic, e.g. perspex and here again they may be each connected through connecting bolts, not shown, such as the connecting bolts 7, to a half upright 4 and to the cradle tray 1. At the position of the rod 5 at the upper end of the cradle tray, at the foot end, the plates may be connected by means of the rod, with end caps 6, already provided in this position. Said plates also contribute to rigidifying the structure. At the head end of the cap, likewise through connecting bolts not shown, the pedestal 2 is provided between the half uprights 4.

Figure 4:
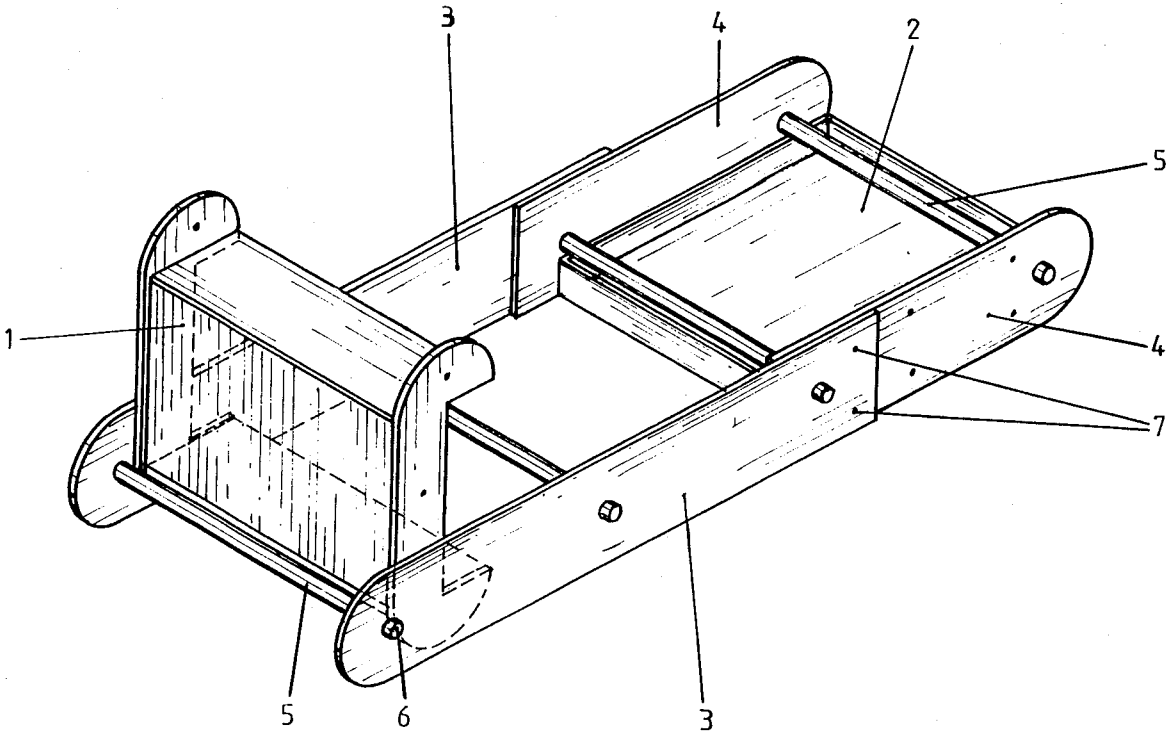
FIG. 4 is a perspective view of the assembly mounted into a bed stead for adults.

A wooden lattice may be placed on the rods 5 interconnecting the uprights 3, except of the rod 5 situated beyond the foot end, such a lattice being known per se and on which the mattress for the cot may be placed. Finally in FIG. 4 the assembly has been shown in the arrangement as a bed stead for adults. Therein the uprights 3 and the half uprights 4 have been placed mutually in alignment, somewhat overlapping each other, the cradle tray 1 being provided at the foot end between the long uprights 3 in like manner as according to FIG. 3. The uprights and half uprights at both sides of the bed stead are interconnected by means of the rod 5 and end caps 6. At the position where an upright 3 and a half upright 4 overlap each other, furthermore connecting bolts, not shown, of the type as indicated by the reference number 7, may be provided, but this is not indispensable, since the uprights rest with a full edge on the floor.

The pedestal 2 may be used in inverted position with respect to FIG. 2 as a drawer and e.g. may be slid at the foot end of the bed below the rod 5 provided there, and below the lattice and the mattress positioned thereon and may serve as a storing space, e.g. for a blanket.

We claim:

1. A furniture assembly selectively convertible into a cradle, a crib and a bed, said furniture assembly comprising a tray, a base having a length substantially equal to that of said tray, a first pair of first boards, a pair of second boards, each of said second boards having a length approximately half that of said first boards, and a plurality of rods, said cradle being formed by situating the base on the ground or floor and connecting said first boards at one end to opposite edges of said base to extend upward therefrom, arranging the second boards on the exterior of said first boards, placing said tray between said first boards and connecting said tray to said first and second boards at substantially half the height of said first boards for pivotal movement about a horizontal axis and interconnecting said first and second boards with one or more of said rods, said crib being formed by situating said first boards standing on a longitudinal edge in horizontal direction, connecting said tray to said first boards at one end thereof and connecting said second boards and base to said first boards at the opposite end thereof, said tray and base extending upwardly from said first boards, and interconnection said first boards by one or more rods, said bed being formed by situating said first boards standing on a longitudinal edge in a horizontal direction, conecting said second boards to one end of said first boards respectively to extend horizontally therefrom, connecting said tray in said first boards in a vertical direction between the other ends thereof and interconnecting said board by one or more rods.

* * * * *